US007980721B2

(12) United States Patent
Gray

(10) Patent No.: US 7,980,721 B2
(45) Date of Patent: Jul. 19, 2011

(54) UNDER CABINET LIGHT FIXTURE

(75) Inventor: Timothy M. Gray, San Dimas, CA (US)

(73) Assignee: Maxim Lighting International, Inc., Industry, CA (US)

( * ) Notice: Subject to any disclaimer, the term of this patent is extended or adjusted under 35 U.S.C. 154(b) by 308 days.

(21) Appl. No.: 12/401,290

(22) Filed: Mar. 10, 2009

(65) Prior Publication Data

US 2010/0232144 A1 Sep. 16, 2010

(51) Int. Cl.
*A47B 97/00* (2006.01)

(52) U.S. Cl. ..... 362/133; 362/134; 362/282; 362/294; 362/311.01; 362/322

(58) Field of Classification Search ..... 362/133, 362/134, 282, 294, 311.01, 322
See application file for complete search history.

(56) References Cited

U.S. PATENT DOCUMENTS 5,426,572 A * 6/1995 Weinstock et al. ..... 362/133
5,658,067 A * 8/1997 Engle et al. ..... 362/222
5,769,529 A * 6/1998 Weinstock et al. ..... 362/133
D440,692 S 4/2001 Janos et al.
D452,340 S 12/2001 Pickett et al.
6,565,234 B1 5/2003 Skegin et al.
7,114,833 B1 10/2006 Pickett et al.
D570,038 S 5/2008 McDowell
7,384,170 B2 6/2008 Skegin
2008/0030983 A1 2/2008 Pickett et al.
2008/0170390 A1 7/2008 McDowell
2008/0298076 A1 12/2008 Skegin

OTHER PUBLICATIONS

Co-pending U.S. Design Appl. No. 29/330,942, filed Jan. 16, 2009.
Co-pending U.S. Design Appl. No. 29/330,941, filed Jan. 16, 2009.
Co-pending U.S. Design Appl. No. 29/330,940, filed Jan. 16, 2009.
Co-pending U.S. Design Appl. No. 29/330,930, filed Jan. 16, 2009.
Co-pending U.S. Design Appl. No. 29/330,933, filed Jan. 16, 2009.
Co-pending U.S. Design Appl. No. 29/330,938, filed Jan. 16, 2009.
Co-pending U.S. Design Appl. No. 29/330,939, filed Jan. 16, 2009.
Co-pending U.S. Appl. No. 12/324,587, filed Nov. 26, 2008.
Co-pending U.S. Design Appl. No. 29/333,842, filed Mar. 16, 2009.

* cited by examiner

*Primary Examiner* — Stephen F Husar
*Assistant Examiner* — James W Cranson
(74) *Attorney, Agent, or Firm* — Bracewell & Giuliani LLP

(57) ABSTRACT

An under cabinet light fixture has a housing with outer surface portions thereof adapted to be positioned closely adjacent, spaced-apart from, and substantially parallel to a substantially planar support surface. The housing has a bottom access panel pivotally connected to it, with first and second panel portions so that the bottom access panel pivots between a closed operating condition and an open access condition. A reflector and lamp sockets are connected to the housing and the reflector is positioned to reflect and radiate light toward and through the second panel portion of the bottom access panel to provide enhanced visibility of light radiating from the support surface when the light fixture is in the operating position.

18 Claims, 10 Drawing Sheets

UNDER CABINET LIGHT FIXTURE

FIELD OF THE INVENTION

The present invention relates to the field of interior lighting, and, more particularly, to a light fixture suitable for mounting under hung cabinets for illuminating an underlying counter surface.

BACKGROUND OF THE INVENTION

Under cabinet light fixtures are available in a number of different designs. A hung cabinet extends out over of the underlying counter surface area. Generally, the cabinet only extends out over 50% of the underlying counter surface area. Most under cabinet light fixtures are installed near the rear side of the cabinet, adequately lighting the rear portion of the underlying counter surface area. However, the counter surface area that is most utilized is the front ⅓ of the total counter surface area. Improvements to increase illumination of the underlying counter surface, and in particular, to increase illumination of the most utilized counter surface areas are desirable.

Generally, when an under cabinet light fixture is mounted to the underside of a cabinet, the light fixture makes significant contact with the cabinet surface. Depending upon the voltage of the light fixture and the number and wattage of bulbs in the fixture, significant heat can be generated when the fixture is operated. Contact between heated surfaces of the light fixture and the cabinet surface increase heat transfer from the fixture to the cabinet surface and can increase the risk of heat damage or fire. Improvements to increase cooling of the under cabinet light fixture and to lower heat transfer between the light fixture and the cabinet surface are desirable.

SUMMARY OF THE INVENTION

An embodiment of the under cabinet light fixture of this invention includes a housing having a top wall with substantially planar outer surface portions adapted to be positioned closely adjacent, spaced-apart from, and substantially parallel to a substantially planar support surface. The substantially planar support surface may extend in a substantially horizontal plane underneath a cabinet. A spaced-apart region between the substantially planar outer surface portions of the top wall and the substantially planar support surface defines an interstitial space to selectively allow air to flow into the interstitial space to enhance cooling of the light fixture in preselected under cabinet mounting positions during operation of the under cabinet light fixture. A front wall is connected to and extends downwardly from the top wall. A rear wall, positioned opposite the front wall, is connected to and extends downwardly from the top wall at an angle substantially perpendicular to the top wall. A pair of opposing end walls are connected to end portions of the top wall, the front wall, and the rear wall so that the inner surfaces of the respective walls define outer boundaries of an inner cavity. Each end wall also has an extended outer surface portion that extends upwardly above the substantially planar outer surface portions of the top wall toward the under cabinet region when positioned adjacent thereto and abuttingly contacting the under cabinet region so that inner surfaces of the respective extended outer surface portions of the pair of end walls define end peripheries of the interstitial space.

A bottom access panel is pivotally connected to the housing along a rear portion of the bottom access panel. The bottom access panel pivots between a closed operating condition when the bottom access panel extends in a plane substantially parallel to the substantially horizontal plane of the under cabinet region and thereby closes the inner cavity, and an open access condition when the bottom access panel pivots and extends downwardly from the housing and from the substantially horizontal plane to provide access to the inner cavity. The bottom access panel includes a first panel portion of non-translucent material and a second panel portion formed of translucent material. The first panel portion is positioned in the substantially parallel plane when the bottom access panel is in the closed position and the second panel portion is positioned to extend upwardly from the substantially parallel plane toward the under cabinet region at a predetermined angle from the substantially parallel plane when the bottom access panel is in the closed position.

A reflector is connected to the housing and is positioned within the inner cavity to reflect light toward the second panel portion of the bottom access panel. At least one lamp socket is connected to the housing and is positioned within the inner cavity so that when a light bulb is positioned in the at least one lamp socket and the light fixture is in an operating condition, light from the light bulb is reflected by the reflector toward and radiates through the second panel portion of the bottom access panel to thereby provide enhanced visibility of light radiating from underneath the cabinet when the light fixture is in the operating position.

BRIEF DESCRIPTION OF THE DRAWINGS

So that the manner in which the features and benefits of the invention, as well as others which will become apparent, may be understood in more detail, a more particular description of the invention briefly summarized above may be had by reference to the embodiments thereof which are illustrated in the appended drawings, which form a part of this specification. It is also to be noted, however, that the drawings illustrate only various embodiments of the invention and are therefore not to be considered limiting of the invention's scope as it may include other effective embodiments as well.

DETAILED DESCRIPTION

The present invention now will be described more fully hereinafter with reference to the accompanying drawings in which a preferred embodiment of the invention is shown. This invention may, however, be embodied in many different forms and should not be construed as limited to the embodiment set forth herein; rather, this embodiment is provided so that this disclosure will be thorough and complete, and will fully convey the scope of the invention to those skilled in the art. Like numbers refer to like elements throughout.

Figure 1:
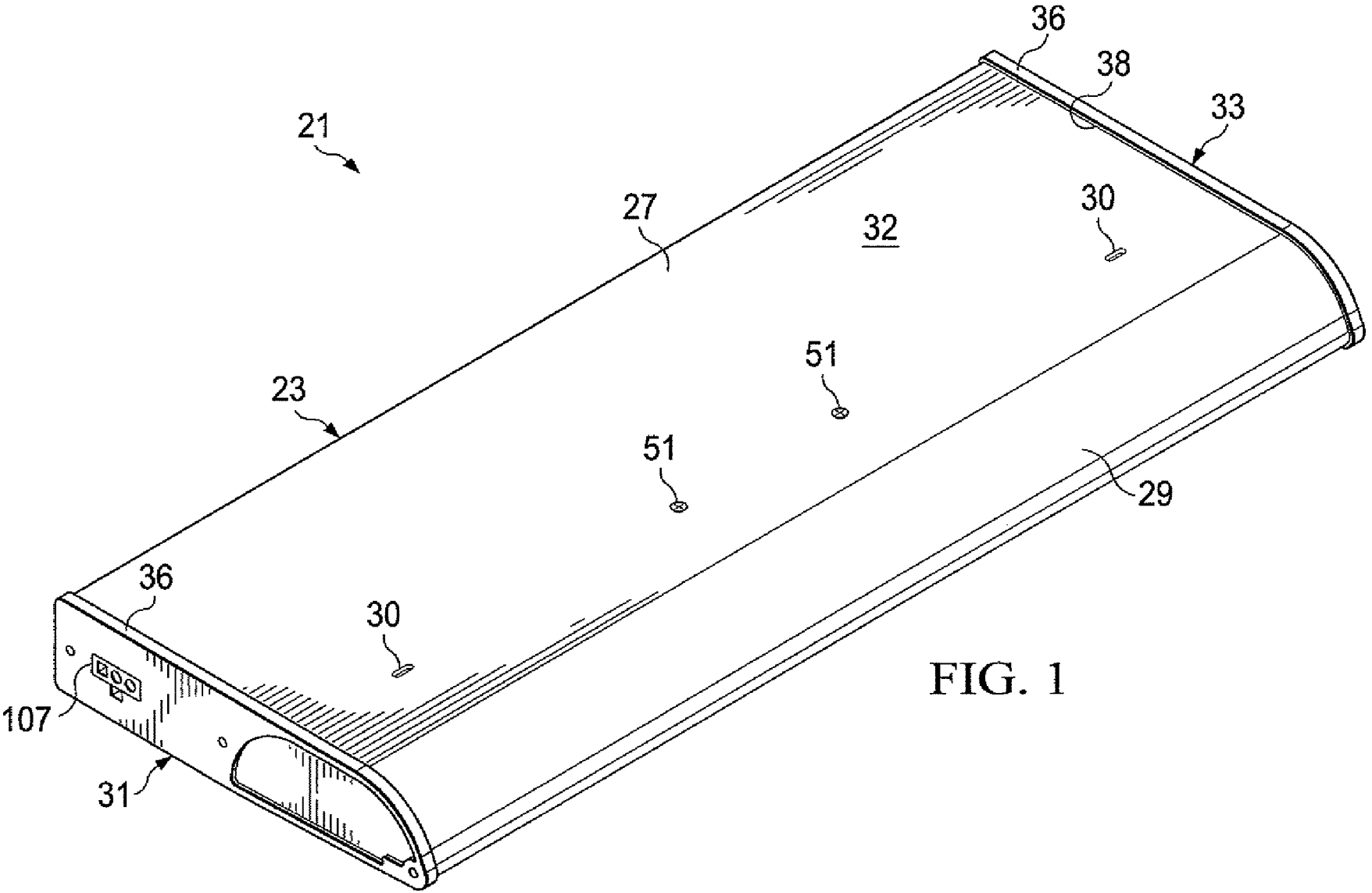
FIG. 1 is a front top perspective view of an under cabinet light fixture according to an embodiment of the present invention.
Figure 2:
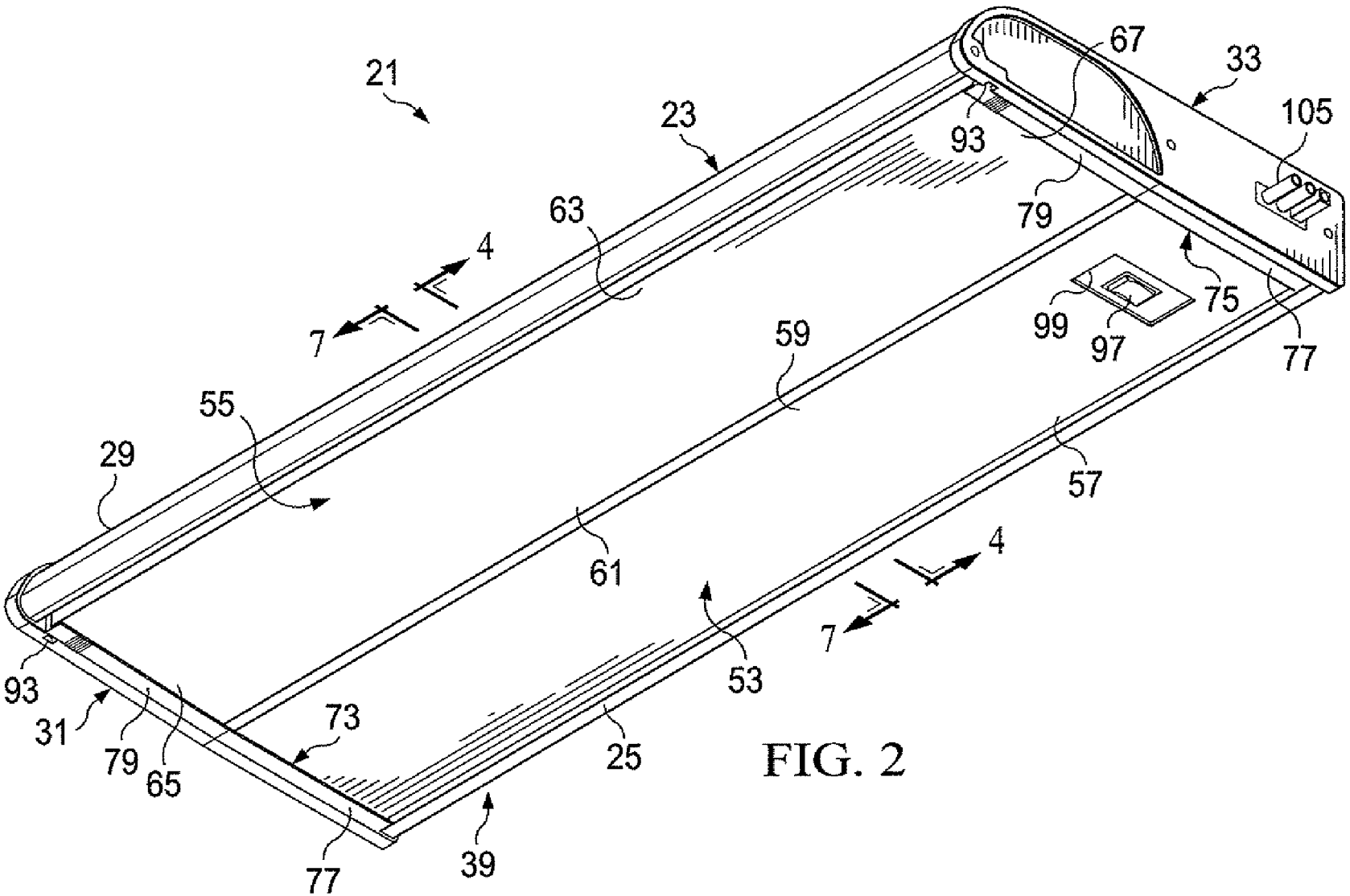
FIG. 2 is a front bottom perspective view of the under cabinet light fixture of FIG. 1.
Figure 3:
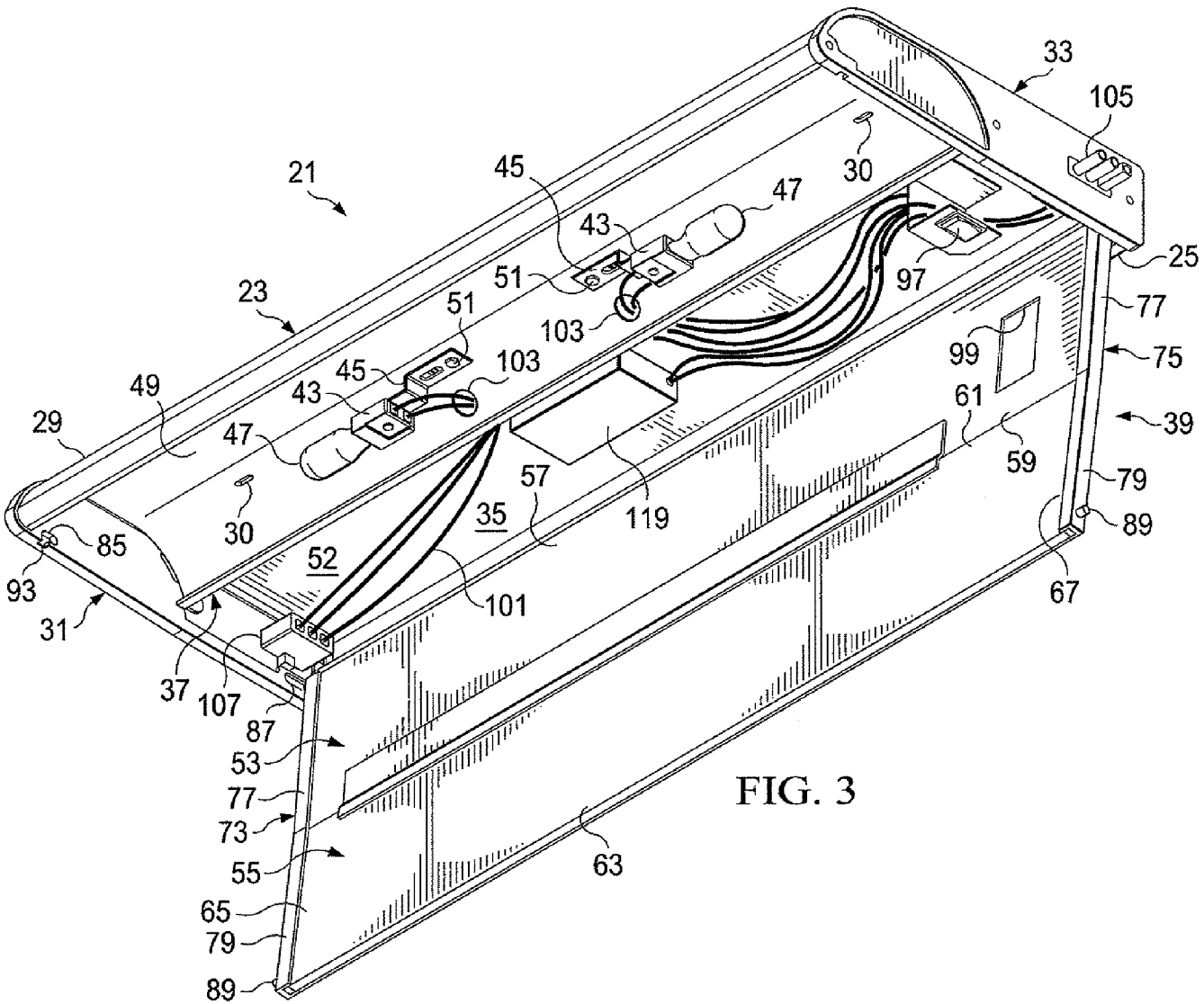
FIG. 3 is a view as in FIG. 2 showing the bottom access panel in an open access position for access to the electrical wiring and the lamps and lamp sockets under the reflector of the fixture.

FIGS. 1-3, illustrate a under cabinet light fixture 21 as comprised by an embodiment of the present invention. The under cabinet light fixture 21 is adapted to be mounted to the underside of a wall cabinet for lighting an underlying counter surface. Although the light fixture 21 may be mounted to numerous support surfaces with different horizontal and vertical orientations, for purposes of example and explanation, the support surface referred to hereinafter will be a support surface of a preferred embodiment. In the preferred embodiment, the under cabinet light fixture 21 is connected to a substantially planar support surface 22 extending in a substantially horizontal plane underneath a cabinet defining an under cabinet region, as best seen in FIGS. 4-7 and 15.

Under cabinet light fixture 21 has a fixture housing 23. As shown in the cross-sectional views of FIGS. 4 through 7, the housing 23 has a rear wall 25, a top wall 27, a front wall 29, and a pair of opposing end walls 31, 33 (FIG. 1). A plurality of slots 30 (FIGS. 1 and 3) are located in and extend through the top wall 27 of the housing 23. The under cabinet light fixture 21 is connected to the support surface 22 by a number of fasteners (not shown in drawings) that pass through the slots 30 and extend into the support surface 22. The top wall 27 has substantially planar outer surface portions 32 adapted to be positioned closely adjacent, spaced-apart from, and substantially parallel to the substantially planar support surface 22. The spaced-apart region between the substantially planar outer surface portions 32 of the top wall 27 and the substantially planar support surface 22 defines an interstitial space 34 to selectively allow air to flow into the interstitial space 34 to enhance cooling of the light fixture 21 in preselected under cabinet mounting positions during operation of the under cabinet light fixture 21.

The front wall 29 is connected to and extends downwardly from the top wall 27. The rear wall 25 is positioned opposite the front wall 29 and is connected to and extends downwardly from the top wall 27 at an angle substantially perpendicular to the top wall 27. End walls 31, 33 are connected to end portions of the top wall 27, the front wall 29, and the rear wall 25. In the preferred embodiment the rear wall 25, top wall 27, and front wall 29 are part of a single extrusion. The inner surfaces of the respective walls 25, 27, 29, 31, 33 define outer boundaries of an inner cavity 35.

The end walls 31, 33 also have an extended end wall outer surface portion 36 that extends upwardly above the substantially planar outer surface portions 34 of the top wall 27 toward the support surface 22 when the end walls 31, 33 are positioned adjacent and in abutting contacting with the support surface 22, as seen in FIGS. 4-7 and 15. The inner surfaces 38 of the respective extended end wall outer surface portions 36 of the pair of end walls 31, 33 define end peripheries of the interstitial space 34.

Figure 5:
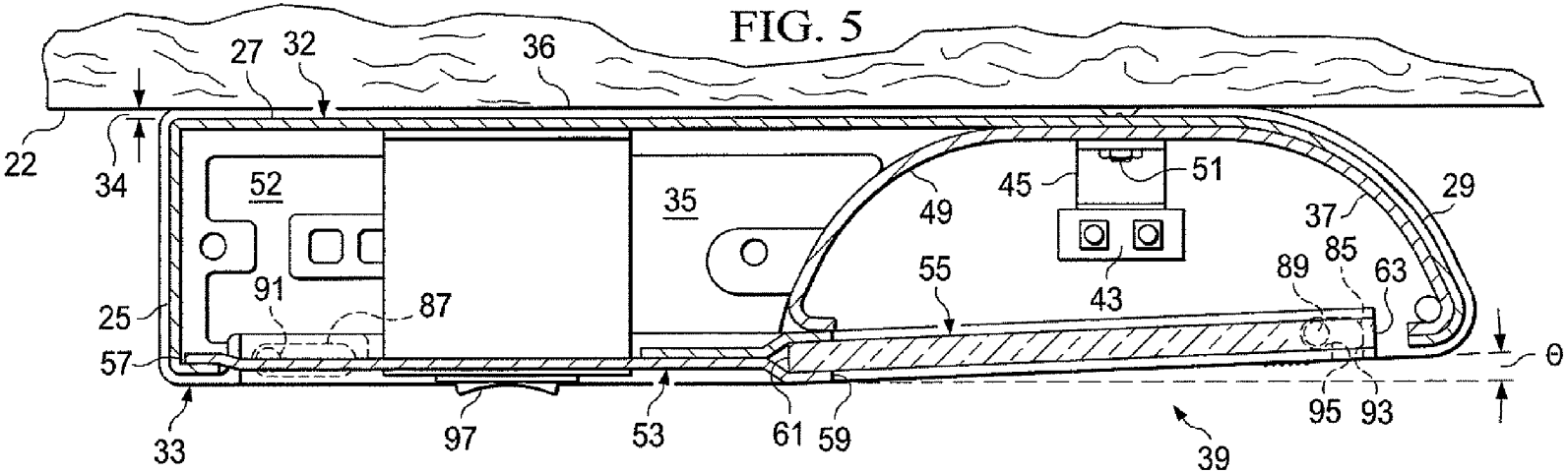
FIG. 5 is a cross-sectional view as in FIG. 4 showing the window panel in a normal closed operating condition.
Figure 6:
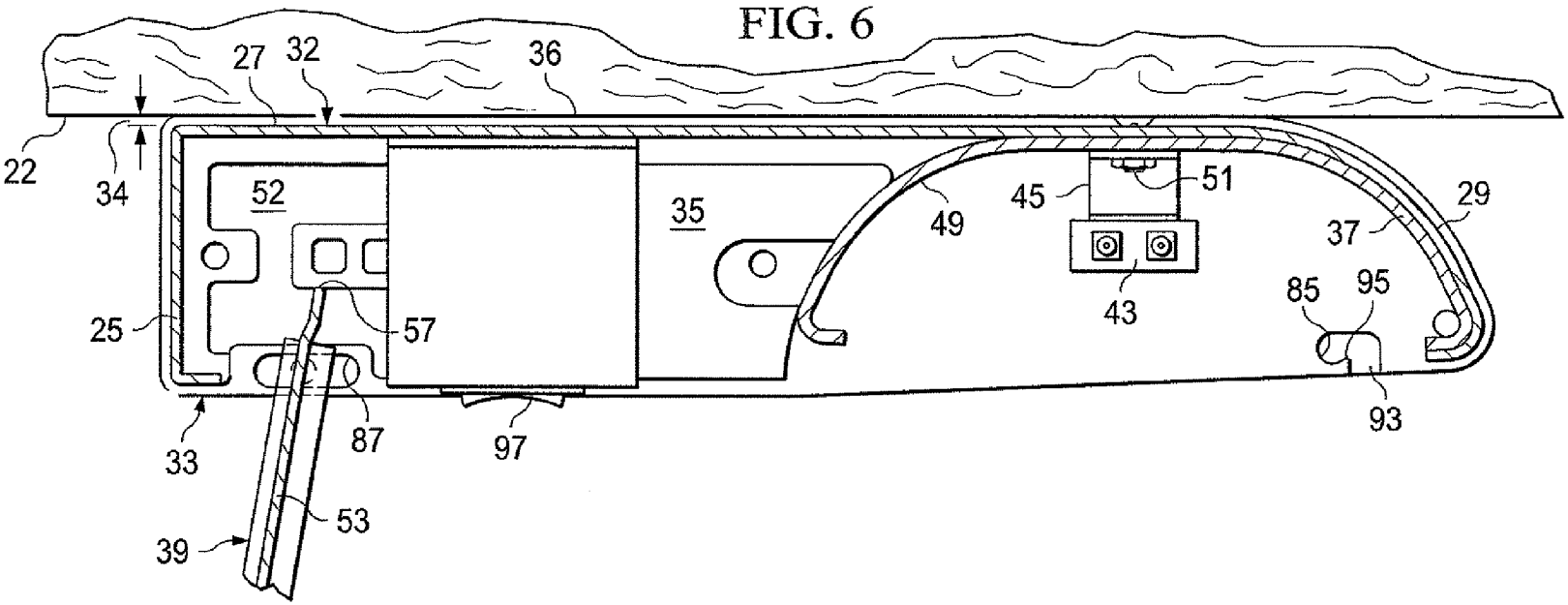
FIG. 6 is an elevational view cross-section taken as in FIG. 5 showing the window panel lowered to its open access condition.

A reflector 37 is connected to the top wall 27 of the housing 23 within the inner cavity 35, and faces the underside of the housing 23. A bottom access panel 39 is pivotally connected to the housing 23 along a rear portion of the bottom access panel 39. The bottom access panel 39 pivots between a closed operating condition, as seen in FIG. 2, when the bottom access panel 39 extends in a plane substantially parallel to the substantially horizontal plane of the support surface 22, thereby closing the inner cavity 35 (FIG. 5); and an open access condition, as seen in FIG. 3, when the bottom access panel 39 pivots and extends downwardly from the housing 23 and from the substantially horizontal plane of the support surface 22, thereby permitting access to the inner cavity 35 (FIG. 6). One or more lamp sockets 43 are connected to the housing 23, positioned within the inner cavity 35. The one or more lamp sockets 43 are connected to and supported on lamp brackets 45, and lamp bulbs 47, such as halogen or xenon light bulbs, are inserted into the one or more sockets 43. In an alternate embodiment, the traditional bulbs may be replaced with light emitting diodes (LEDs). For purposes of explanation and example the drawings show a two lamp under cabinet light fixture, however, additional embodiments of under cabinet light fixture 21 can be constructed to support a various number of lamp sockets 43.

The light reflector 37 has a reflecting undersurface 49. In an embodiment of the under cabinet light fixture 21, the reflector 37 is connected to the housing 23 by a pair of screws 51 that extend through the top wall 27 and into the inner cavity 35, securely connecting the lamp brackets 45 to the housing 23. A rear compartment 52 is formed in the inner cavity 35 between the rear wall 25 and the reflector 37.

Figure 7:
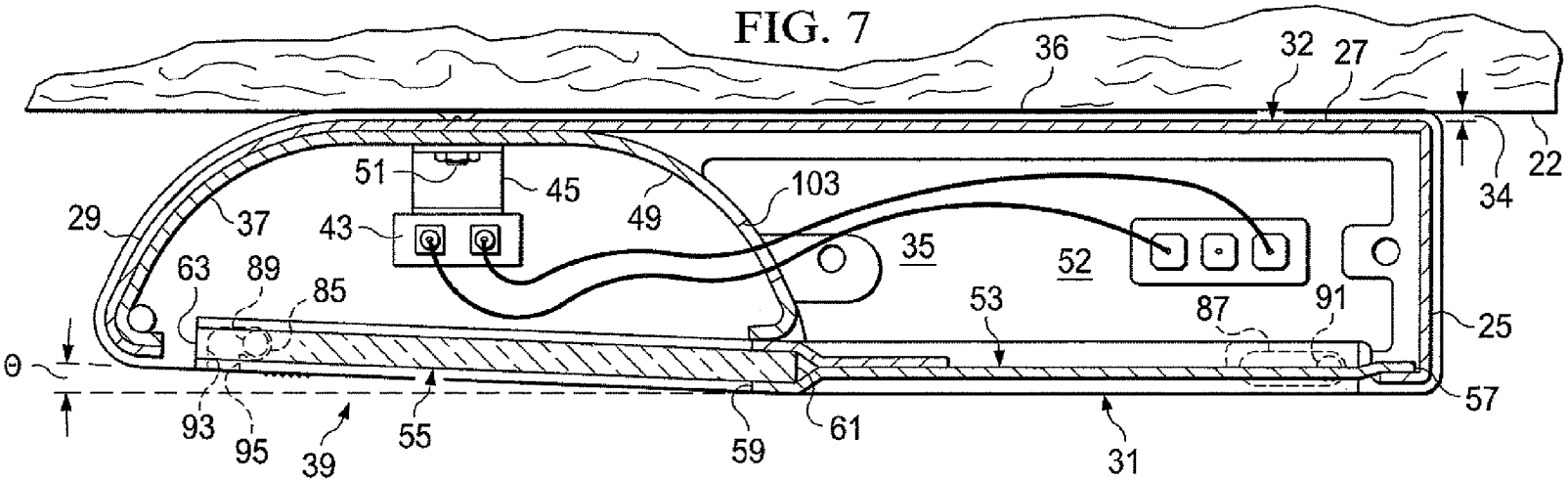
FIG. 7 is an elevational cross-section taken along the line 7-7 in FIG. 2 showing electrical wiring passing from the rear compartment to the a lamp socket for supplying electrical power to the socket.

The bottom access panel 39 includes a first panel portion 53 of non-translucent material and a second panel 55 portion formed of translucent material. The first panel portion 53 has a rear edge 57 and a front edge 59. The second panel portion 55 has a rear edge 61 and a front edge 63. The bottom access panel has two opposite sides 65, 67 extending between the rear edge 57 of the first panel portion 53 and the front edge 63 of the second panel portion 55. The first panel portion 53 is connected to the second panel portion 55 along the front edge 59 to the rear edge 65 of the second panel portion 55. The first panel 53 is positioned in the substantially parallel plane of the support surface 22 when the bottom access 39 panel is in the closed position. The second panel portion 55 is positioned to extend upwardly from the substantially parallel plane of the support surface 22 toward the under cabinet region at a predetermined angle θ from the substantially parallel plane of the support surface 32 when the bottom access panel 39 is in the closed position, as seen in FIGS. 5 and 7.

Figure 9:
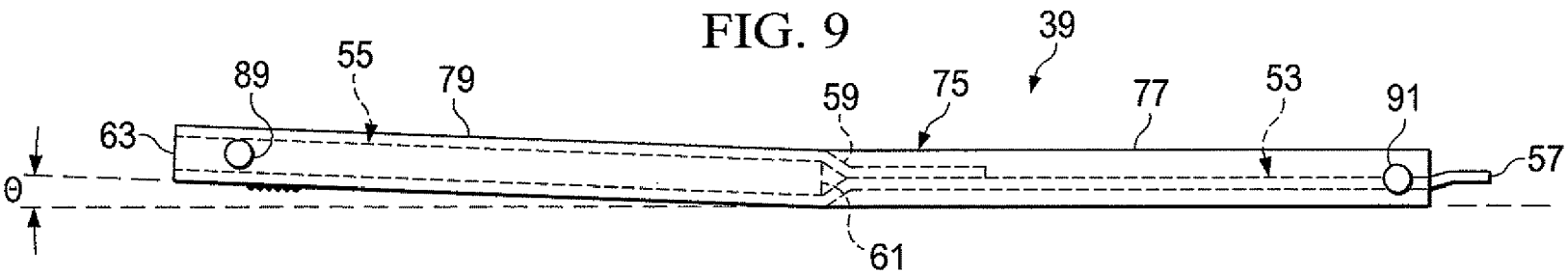
FIG. 9 is a side elevational view of bottom access panel of the fixture of FIG. 1.

A pair of retaining clips 73, 75 are each positioned to receive the respective two opposite sides 65, 67 of each of the first panel portion 53 and the second panel portion 55. The retaining clips 73, 75 retain the respective first panel portion 53 and the second panel portion 55. Each one of the pair of retaining clips 73, 75 of the bottom access panel 39 has a first leg extension 77 extending from the rear portion of the bottom access panel 39 toward the front portion of the bottom access panel 39 and a second leg extension 79 extending upwardly from the first leg portion 77 along a medial region of the respective one of the pair of retaining clips 73, 75 at the predetermined angle θ, as seen in FIG. 9. The first panel portion 53 is retained by the respective first leg portions 77 of each one of the retaining clips 73, 75 and the second panel portion 55 is retained by the respective second leg portions 79 of each one of the retaining clips 73, 75. The bottom access panel 39 is orientated so that when a light bulb 47 is positioned in the at least one lamp socket 43 and the light fixture 21 is in an operating condition, light from the light bulbs 47 is reflected by the reflector 37 toward and radiates through the second panel portion 55 of the bottom access panel 39 to thereby provide enhanced visibility of light radiating from underneath the cabinet when the light fixture 21 is in the operating position. In a preferred embodiment, the bottom surface of the end walls 31, 33 may be geometrically complimentary to the bottom access panel 39 when the bottom access panel 39 is in the closed operating position such that the bottom surface of the end walls 31, 33 is flush with the bottom access panel 39, as seen in FIGS. 2 and 5.

Figure 4:
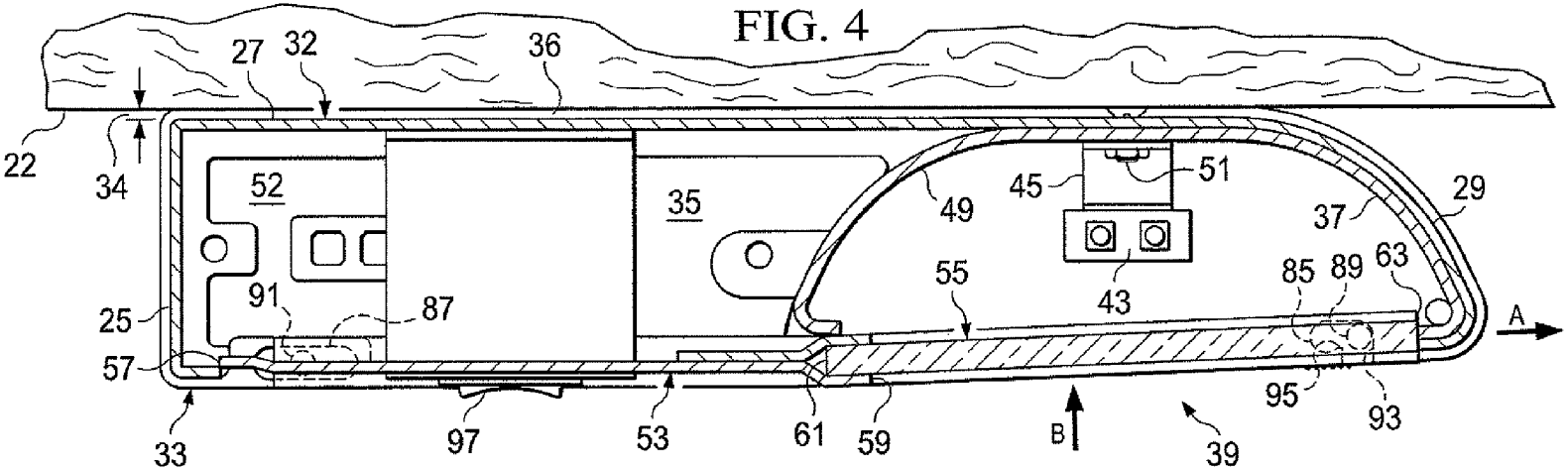
FIG. 4 is an elevational cross-section of the light fixture taken along the line 4-4 of FIG. 2 showing the bottom access panel displaced for freeing the front pins from their detents by pressing the window panel upwards and forwards to a released condition as indicated by the arrows in the Figure in preparation for lowering the bottom access panel to the open access condition of FIG. 3.

As seen in FIG. 4, each end wall 31, 33 has a slot 81 located in the inner surface 83 of the end walls 31, 33, the slot 81 extends along outer peripheries of a rear portion, a top portion, and a front portion of the inner surface 83 to receive the respective edges of the rear wall 25, the top wall 27, and the front wall 29 of the housing 23. The slot 81 is geometrically complimentary to the respective edges of the rear wall 25, top wall 27, and front wall 29 of the housing 23 such that the edges of the respective walls 25, 27, 29 are captured within the slot 81. Additionally, each end wall 31, 33 has a front slot 85 located in the bottom portion of the inner surface 83, positioned adjacent the front wall 29. A rear slot 87 is located in a rear bottom portion of the inner surface 83, adjacent the rear wall 25.

Figure 8:
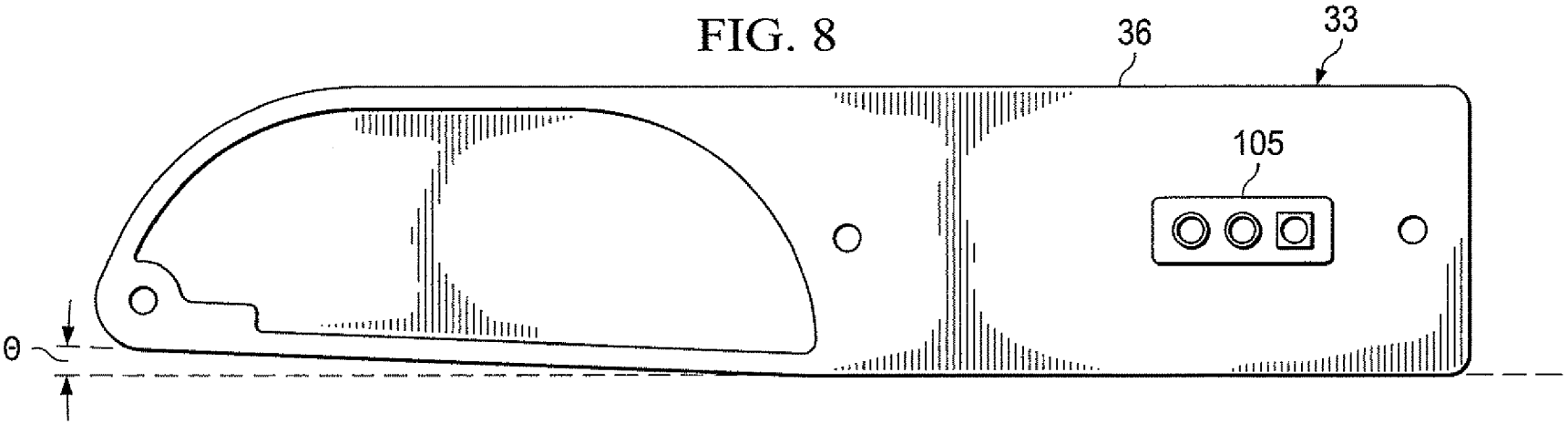
FIG. 8 is a side elevational view of one of the end walls of the fixture of FIG. 1.

Each of the two opposite sides 65, 67 of the bottom access panel has a front pin 89 and a rear pin 91. Each pin 89, 91 is supported in the corresponding front slot 85 and rear slot 87, respectively. Front slots 85 have open bottom ends 93. Rear slots 87 permit limited sliding displacement of the bottom access panel 39 in a generally horizontal plane as indicated by the arrow A in FIG. 4. However, each front slot 85 has a pin detent 95 (FIGS. 4-7) near its open bottom end 93 shaped to hold the front pin 89 against sliding movement through the open bottom end 93. Front pins 89 are released through open ends 93 by lifting the bottom access panel 39 and pins 89 over the pin detents 95 as suggested by arrow B in FIG. 4 in order to free the bottom access panel 39 from its normal closed operation position of FIGS. 2 and 5 to a released access condition shown in FIG. 4. Once front pins 89 are released from front slots 85 as in FIG. 4 the bottom access panel 39 is free to swing or pivot about the rear pins 91 captive in rear slots 87, allowing the front edge 63 of the bottom access panel 39 to drop away from the fixture housing 23 to the open access condition of the bottom access panel 39. The two rear pins 91 remain captive in their corresponding rear slots 87 such that the rear edge 57 of the bottom access panel 39 remains hinged about the rear pins 91 to the housing 23 for pivotal movement to its open access condition. The front pin 89 and rear pin 91 on each side 65, 67 of the bottom access panel 39 can be formed as integral parts of the corresponding retaining clips 73, 75 fit on each side 65, 67 of the bottom access panel 39, as best seen in FIGS. 2, 3, and 8.

The bottom access panel 39 is released from its closed operating condition by pressing upwardly on the opposite ends 65, 57 of the bottom access to raise the front edge 65 of the bottom access panel 39 and lift the front pins 89 over pin detents 95, while at the same time pushing the bottom access panel 39 forwardly in slots 85, 87 as suggested by arrows A and B in FIG. 4 until front pins 89 are freed from front slots 85.

An electrical power switch 97 is mounted to the top wall 27 within the inner cavity 35 of the housing 23. An aperture 99 is positioned in and extends through the bottom access panel 39, such that the electrical power switch 97 extends through the aperture 99 and through the bottom access panel 39, when the bottom access panel 39 is in the closed operating position.

Electrical wiring 101 is placed in the inner cavity 35 in the space between the reflector 37 and the rear wall 25. The electrical wiring 101 is connected through the switch 97 for supplying and distributing electrical power to the lamp socket or sockets 43 of under cabinet light fixture 21. The rear compartment 52 between the reflector 37 and the rear wall 25 within inner cavity 35 provides a conduit for the electrical wiring 101 along the fixture housing 23. One or more pass through openings 103 are provided in the reflector 37 to admit the wiring 101 from the rear compartment 52 to lamp sockets 43 as shown in FIGS. 3, 7, and 9.

Figure 10:
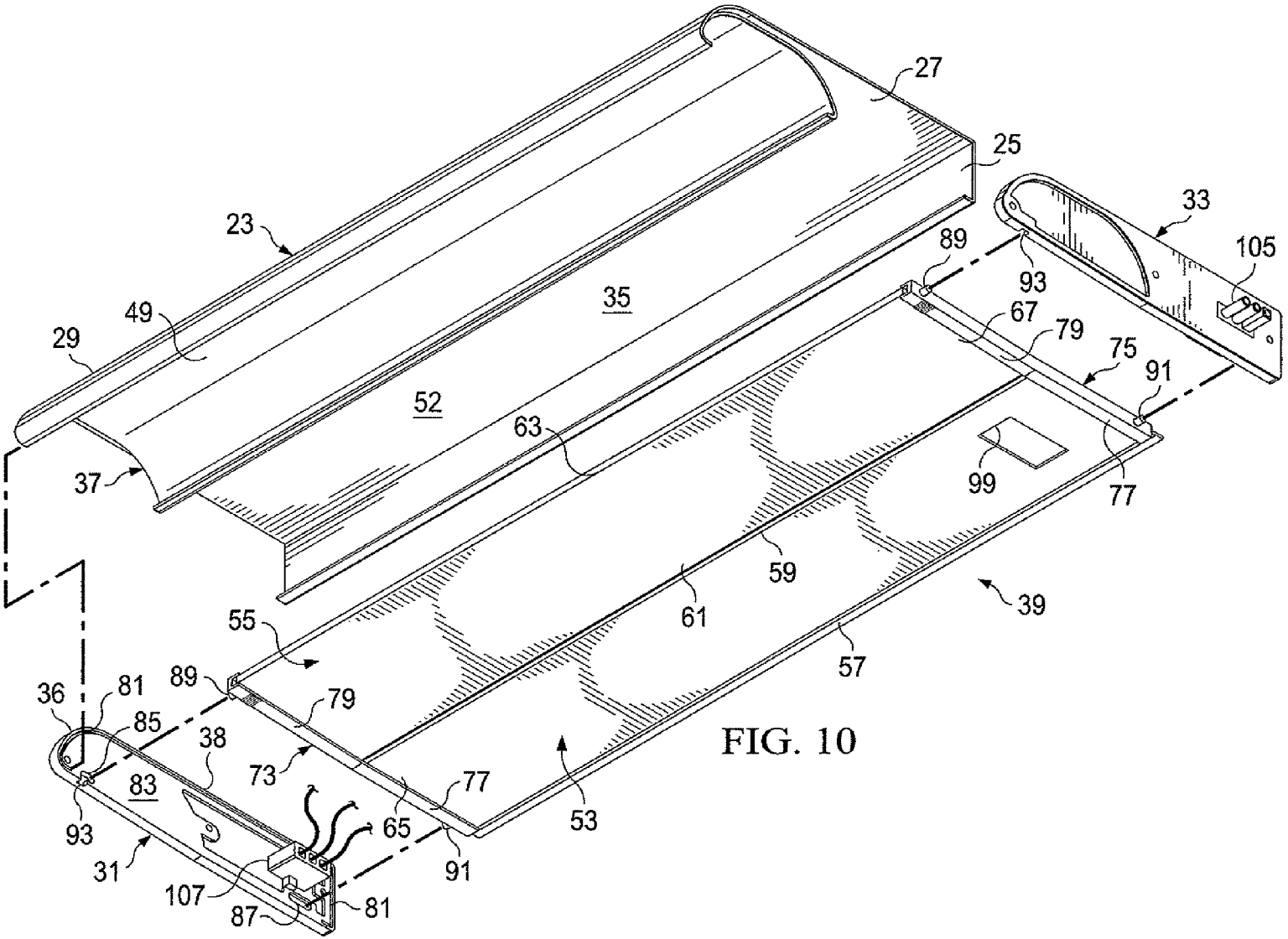
FIG. 10 is an exploded detailed view showing the housing and bottom access panel of the fixture of FIG. 1.
Figure 11:
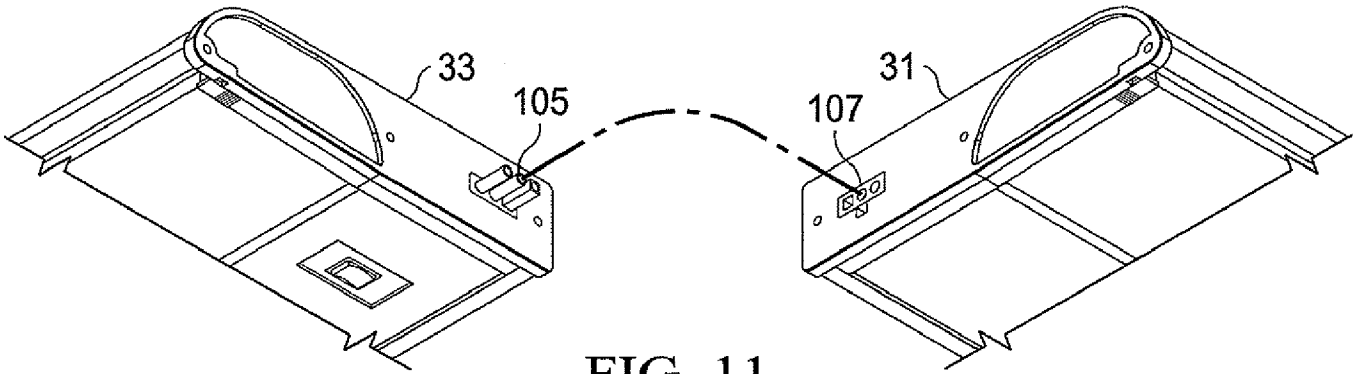
FIG. 11 depicts the mating of connectors of opposite genders on two fixtures installed end-to-end.
Figure 13:
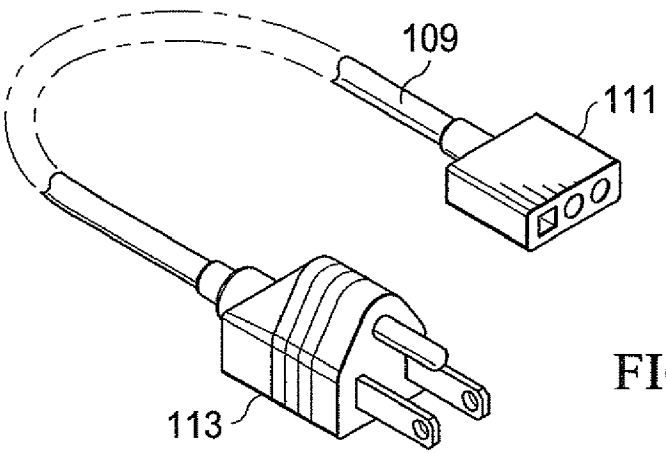
FIG. 13 shows the end connectors of a AC power cord by which the light fixture of FIG. 1 can be supplied with electrical power from an existing electrical outlet.

The under cabinet light fixture 21 can be configured for hard wired installation or for self-installation. For hard wired installation, typically done by an electrician, one or more knock out openings (not shown in the drawings) may be provided in a convenient location such as the rear wall 25 for passing external electrical power wiring into the inner cavity 35. For self installation, male and female electrical connectors 105, 107 respectively are provided on end walls 31, 33 as shown in FIGS. 1, 3, 9, and 10. End connectors 105, 107 may be connected to each other by wiring 101 in the inner cavity 35 for passing electrical power through the fixture 21 from one end connector to the other. One or both end connectors 105, 107 are also normally connected for supplying to lamp sockets 43. Either of connectors 105, 107 can mate to an external power cord 109 equipped with an appropriately configured mating connector 111 and a power plug 113 mateable to an electrical wall outlet, such as shown in FIG. 13 for supplying electrical power to the lamp sockets 43. Each connector 105, 107 can mate to a connector 105, 107 of opposing gender on an adjacent light fixture 21, for connecting end-to-end one counter light fixture 21 to another counter light fixture 21 as depicted in FIG. 10, so that only one of the connected light fixtures 21 requires connection to an external line voltage source.

Figure 12:
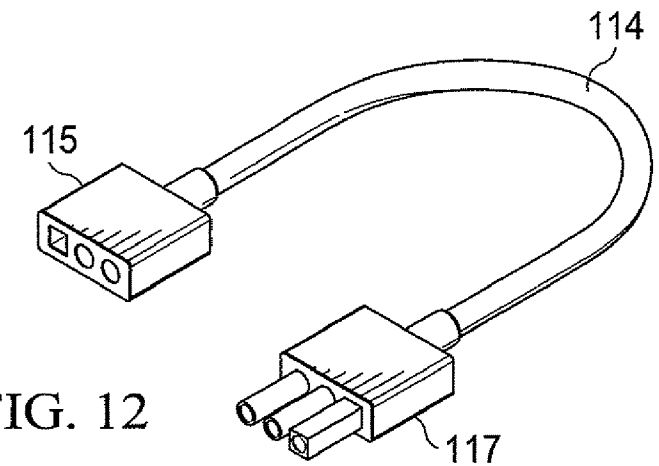
FIG. 12 shows a power jumper cable for connecting end connectors of FIG. 11 where the fixtures are spaced apart from each other.
Figure 14:
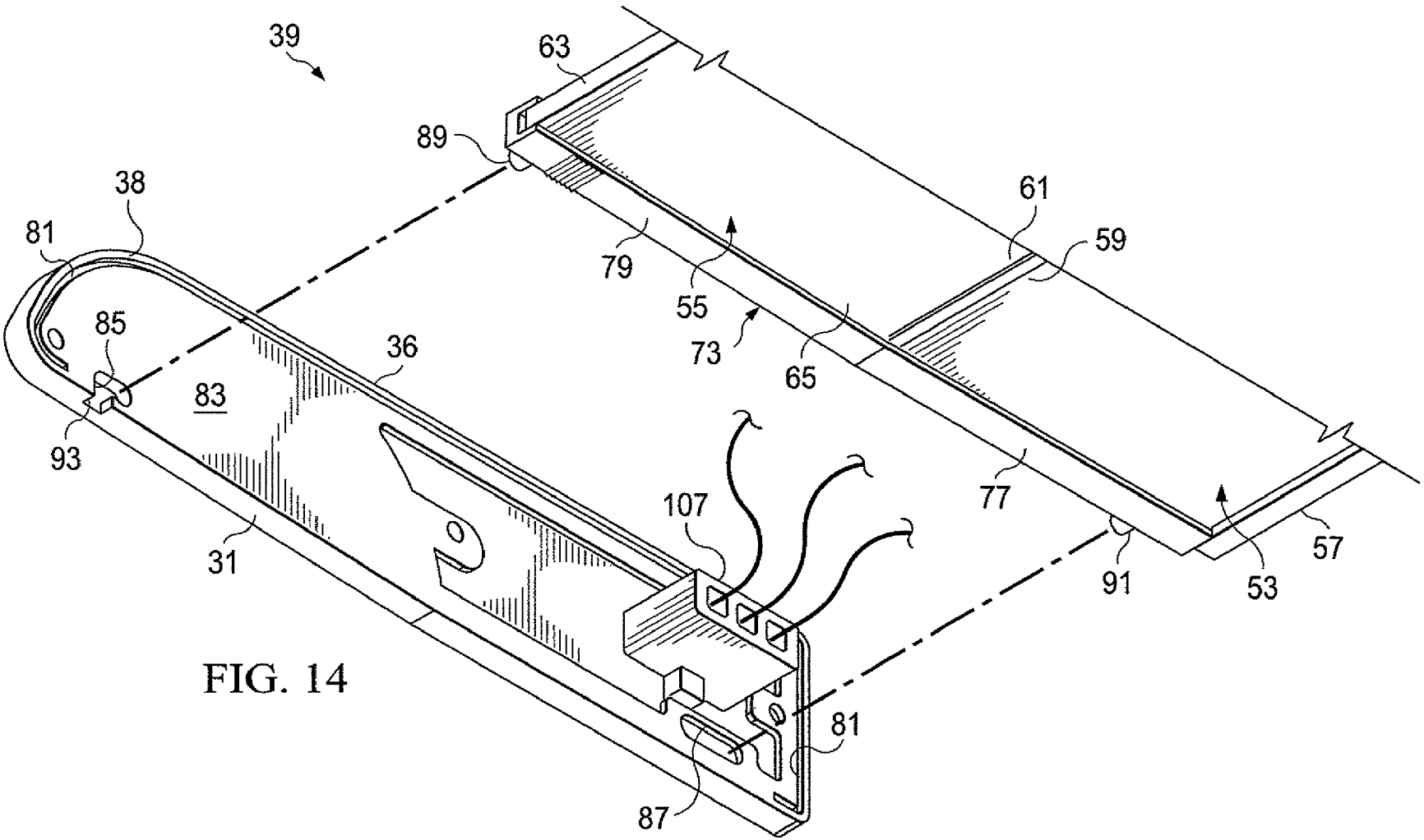
FIG. 14 shows an enlarged and isolated view of one of the end walls of FIG. 10.
Figure 15:
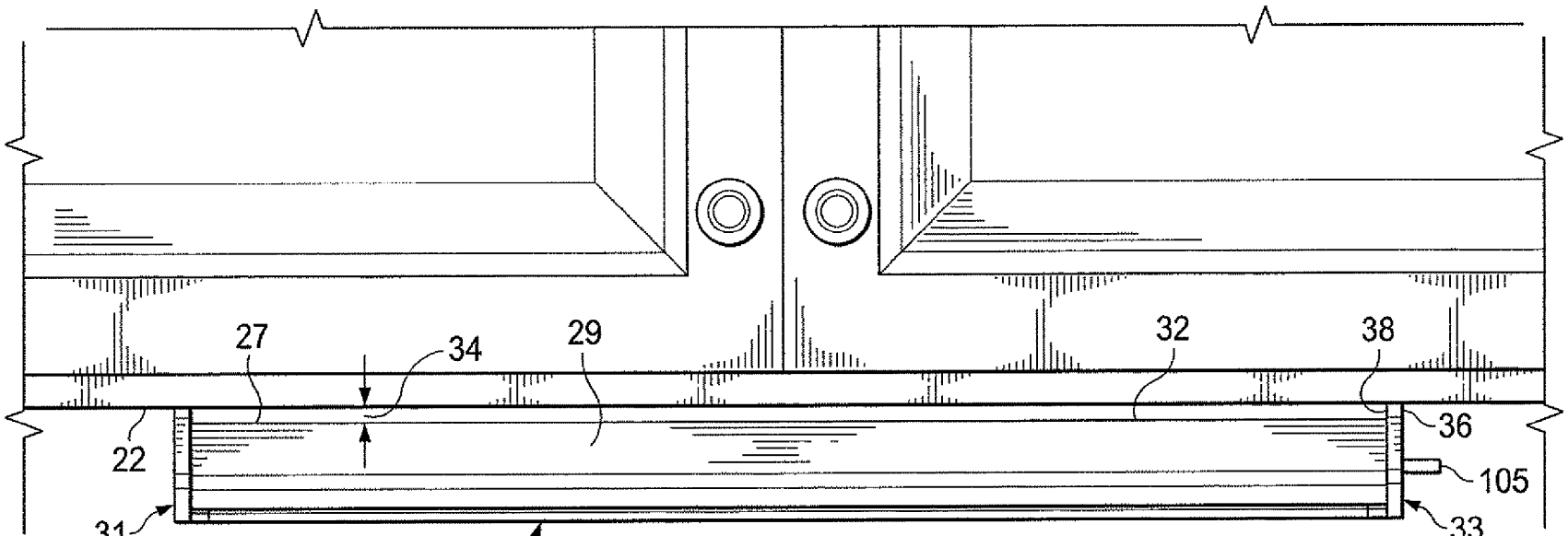
FIG. 15 shows a front elevational view of an embodiment of the under cabinet light fixture of the present invention mounted to a cabinet.

A jumper cord 114 as shown in FIG. 12 may be provided with connections 115, 117 of opposite gender for interconnecting end connectors 105, 107 of two spaced apart light fixtures 21, where direct mating of end connectors 105, 107 is not possible because of spacing.

The counter light fixtures of this invention can be configured for use with either high voltage (e.g. 110 Volts) or low voltage (e.g. 12 Volt) lamp bulbs in lamp sockets 43. As previously indicated, in an alternate embodiment, traditional bulbs may be replaced with LEDs. For low voltage use a power transformer 119 is provided, which can be conveniently installed within the inner cavity 35, as shown in FIG. 3, and connected for converting a line voltage input of the light fixture to a low voltage supply for the lamp sockets 43.

The embodiments of the present invention offer several advantages over other under cabinet light fixtures. By providing end walls with surfaces that extend above the top wall of the housing, the under cabinet light fixture of the present invention eliminates surface contact between the top wall and the support surface and allows air to flow over the top of the housing, thereby decreasing heat transfer between the light fixture and the support surface. Additionally, by providing a bottom access panel that angles upwardly toward the support surface, the under cabinet light fixture of the present invention can reflect and radiate light toward underlying counter surfaces that previously did not receive light from the fixture, thereby providing enhanced visibility of light radiating from underneath the support surface.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent however, that various modifications and changes can be made within the spirit and scope of the invention as described in the foregoing specification and as set forth in the following claims.

That claimed is:

1. An under cabinet light fixture comprising:

a housing including a top wall having substantially planar outer surface portions thereof adapted to be positioned closely adjacent, spaced-apart from, and substantially parallel to a substantially planar support surface extending in a substantially horizontal plane underneath a cabinet defining an under cabinet region so that a spaced-apart region between the substantially planar outer surface portions thereof and the substantially planar support surface defines an interstitial space to thereby selectively allow air to flow into the interstitial space to enhance cooling of the light fixture in preselected under cabinet mounting positions during operation of the under cabinet light fixture, a front wall connected to and extending downwardly from the top wall, a rear wall opposite the front wall connected to and extending downwardly from the top wall at an angle substantially perpendicular to the top wall, a pair of opposing end walls each being connected to end portions of the top wall, the front wall, and the rear wall so that the inner surfaces of the respective walls define outer boundaries of an inner cavity, each end wall also having an extended end wall outer surface portion thereof extending upwardly above the substantially planar outer surface portions of the top wall toward the under cabinet region when positioned adjacent thereto and abuttingly contacting the under cabinet region so that inner surfaces of the respective extended end wall outer surface portions of the pair of end walls define end peripheries of the interstitial space;

a bottom access panel pivotally connected to the housing along a rear portion of the bottom access panel so that the bottom access panel pivots between a closed operating condition when the bottom access panel extends in a plane substantially parallel to the substantially horizontal plane of the under cabinet region and thereby closes the inner cavity and an open access condition when the bottom access panel pivots and extends downwardly from the housing and from the substantially horizontal plane to thereby permit access to the inner cavity, the bottom access panel including a first panel portion of non-translucent material and a second panel portion formed of translucent material, the first panel portion being positioned in the substantially parallel plane when the bottom access panel is in the closed position and the second panel portion being positioned to extend upwardly from the substantially parallel plane toward the under cabinet region at a predetermined angle from the substantially parallel plane when the bottom access panel is in the closed position;

a reflector connected to the housing, positioned within the inner cavity and positioned to reflect light toward the second panel portion of the bottom access panel; and at least one lamp socket connected to the housing, positioned within the inner cavity, and positioned so that when a light bulb or a light emitting diode is positioned in the at least one lamp socket and the light fixture is in an operating condition, light from the light bulb or the light emitting diode is reflected by the reflector toward and radiates through the second panel portion of the bottom access panel to thereby provide enhanced visibility of light radiating from underneath the cabinet when the light fixture is in the operating position.

2. An under cabinet light fixture as defined in claim 1, wherein the bottom access panel further comprises:

a front portion and each of the first panel portion and the second panel portion having two opposite sides collectively extending between the rear portion and the front portion;

a pair of retaining clips each positioned to receive the respective two opposite sides of each of the first panel portion and the second panel portion to thereby retain the respective first and second panel portions therein; and the first panel portion also being connected to the second panel portion along a front edge thereof to a rear edge of the second panel portion so that pivotal movement of the first panel portion from the closed operating condition to the open access condition also moves the second panel portion and so that such pivotal movement to the open access condition allows access into the inner cavity through both the first and second panel portions collectively.

3. An under cabinet light fixture as defined in claim 2, wherein each one of the pair of retaining clips of the bottom access panel has a first leg extension extending from the rear portion of the bottom access panel toward the front portion of the bottom access panel and a second leg extension extending upwardly from the first leg portion along a medial region of the respective one of the pair of retaining clips at the predetermined angle, the first panel portion being retained by the respective first leg portions of each one of the retaining clips and the second panel portion being retained by the respective second leg portions of each one of the retaining clips.

4. An under cabinet light fixture as defined in claim 1, wherein each end wall further comprises a slot located in the inner surface thereof and extending along outer peripheries of a rear portion, a top portion, and a front portion of the inner surface to receive therein respective edges of the rear wall, top wall, and front wall of the housing and to be geometrically complimentary to the respective edges of the rear wall, top wall, and front wall of the housing such that the edges of the respective walls are captured within the slot, and wherein each of the respective retaining clips of the bottom access panel connect to a bottom portion of the respective ends when the bottom access panel is in the closed operating condition.

5. An under cabinet light fixture as defined in claim 4, wherein each end wall further comprises:

a front slot located in the bottom portion of the inner surface thereof, adjacent the front wall;

a rear slot located in a rear bottom portion of the inner surface thereof adjacent the rear wall; and wherein each of respective retaining clips further comprises:

a rear pin extending outwardly therefrom and into in the rear slot; and a front pin extending outwardly therefrom and into the front slot, the front pin being slidable in the front slot for freeing the front pin through an open bottom end thereof to release the bottom access panel for pivotal movement about the rear pin to the open access condition.

6. A light fixture comprising:

a housing including a top wall, a front wall connected to and extending downwardly from the top wall, a rear wall opposite the front wall connected to and extending downwardly from the top wall, a pair of opposing end walls each being connected to end portions of the top wall, the front wall, and the rear wall so that the inner surfaces of the respective walls define outer boundaries of an inner cavity;

a bottom access panel pivotally connected to the housing so that the bottom access panel pivots between a closed operating condition and an open access condition, the bottom access panel including a first panel portion and a second panel portion, the first panel portion being positioned in the substantially parallel plane when the bottom access panel is in the closed position and the second panel portion being positioned to extend toward the support surface at a predetermined angle therefrom when the bottom access panel is in the closed position;

a reflector connected to the housing, positioned within the inner cavity and positioned to reflect light toward the second panel portion of the bottom access panel; and at least one lamp socket connected to the housing, positioned within the inner cavity, and positioned so that when a light bulb or a light emitting diode is positioned in the at least one lamp socket and the light fixture is in an operating condition, light from the light bulb or the light emitting diode is reflected by the reflector toward and radiates through the second panel portion of the bottom access panel when the light fixture is in the operating position.

7. A light fixture as defined in claim 6, wherein the first panel portion is formed of non-translucent material and the second panel portion is formed of translucent material.

8. A light fixture as defined in claim 6, the top wall further comprising:

substantially planar outer surface portions thereof adapted to be positioned closely adjacent and substantially parallel to a substantially planar support surface; and the light fixture further comprising:

each end wall having an extended end wall outer surface portion thereof extending outwardly from the top wall toward the support surface when positioned adjacent thereto and abuttingly contacting the support surface; and wherein the substantially planar outer surface portions are spaced-apart from the substantially planar support surface so that a spaced-apart region between the substantially planar outer surface portions thereof and the substantially planar support surface defines an interstitial space to thereby selectively allow air to flow into the interstitial space to enhance cooling of the light fixture during operation; and wherein inner surfaces of the respective extended end wall outer surface portions of the pair of end walls define end peripheries of the interstitial space.

9. A light fixture as defined in claim 6, wherein the bottom access panel further comprises:

a front portion and each of the first panel portion and the second panel portion having two opposite sides collectively extending between the rear portion and the front portion;

a pair of retaining clips each positioned to receive the respective two opposite sides of each of the first panel portion and the second panel portion to thereby retain the respective first and second panel portions therein; and the first panel portion also being connected to the second panel portion along a front edge thereof to a rear edge of the second panel portion so that pivotal movement of the first panel portion from the closed operating condition to the open access condition also moves the second panel portion and so that such pivotal movement to the open access condition allows access into the inner cavity through both the first and second panel portions collectively.

10. A light fixture as defined in claim 9, wherein each one of the pair of retaining clips of the bottom access panel has a first leg extension extending from the rear portion of the bottom access panel toward the front portion of the bottom access panel and a second leg extension extending upwardly from the first leg portion along a medial region of the respective one of the pair of retaining clips at the predetermined angle, the first panel portion being retained by the respective first leg portions of each one of the retaining clips and the second panel portion being retained by the respective second leg portions of each one of the retaining clips.

11. A light fixture as defined in claim 6, wherein each end wall further comprises a slot located in the inner surface thereof and extending along outer peripheries of a rear portion, a top portion, and a front portion of the inner surface to receive therein respective edges of the rear wall, top wall, and front wall of the housing and to be geometrically complimentary to the respective edges of the rear wall, top wall, and front wall of the housing such that the edges of the respective walls are captured within the slot, and wherein each of the respective retaining clips of the bottom access panel connect to a bottom portion of the respective ends when the bottom access panel is in the closed operating condition.

12. A light fixture as defined in claim 11, wherein each end wall further comprises:

a front slot located in the bottom portion of the inner surface thereof, adjacent the front wall;

a rear slot located in a rear bottom portion of the inner surface thereof, adjacent the rear wall; and wherein each of respective retaining clips further comprises:

a rear pin extending outwardly therefrom and into in the rear slot; and a front pin extending outwardly therefrom and into the front slot, the front pin being slidable in the front slot for freeing the front pin through an open bottom end thereof to release the bottom access panel for pivotal movement about the rear pin to the open access condition.

13. A light fixture comprising:

a housing adapted to be connected to a substantially planar support surface;

a bottom access panel pivotally connected to the housing along a rear portion of the bottom access panel so that the bottom access panel pivots between a closed position and an open position, the bottom access panel including a first panel portion and a second panel portion, the first panel portion being positioned in the substantially parallel plane when the bottom access panel is in the closed position and the second panel portion being positioned to extend toward the support surface at a predetermined angle therefrom when the bottom access panel is in the closed position;

a reflector connected to the housing and positioned to reflect light toward the bottom access panel; and at least one lamp socket connected to the housing and positioned so that when a light bulb or a light emitting diode is positioned in the at least one lamp socket and the light fixture is in an operating condition, light from the light bulb or the light emitting diode is reflected by the reflector toward and radiates through the bottom access panel to thereby provide enhanced visibility of light radiating therefrom.

14. A light fixture as defined in claim 13, wherein the housing further comprises:

a top wall having substantially planar outer surface portions thereof adapted to be positioned closely adjacent, spaced-apart from, and substantially parallel to a substantially planar support surface so that a spaced-apart region between the substantially planar outer surface portions thereof and the substantially planar support surface defines an interstitial space to thereby selectively allow air to flow into the interstitial space to enhance cooling of the light fixture during operation, a front wall connected to and extending downwardly from the top wall, a rear wall opposite the front wall connected to and extending downwardly from the top wall, a pair of opposing end walls each being connected to end portions of the top wall, the front wall, and the rear wall so that the inner surfaces of the respective walls define outer boundaries of an inner cavity, each end wall also having an extended end wall outer surface portion thereof extending outwardly from the substantially planar outer surface portions of the top wall toward the support surface when positioned adjacent thereto and abuttingly contact the support surface so that inner surfaces of the respective extended end wall outer surface portions of the pair of end walls define end peripheries of the interstitial space; and wherein the reflector and at least one lamp socket are positioned within the inner cavity.

15. A light fixture as defined in claim 14, wherein the bottom access panel further comprises:

a front portion and each of the first panel portion and the second panel portion having two opposite sides collectively extending between the rear portion and the front portion;

a pair of retaining clips each positioned to receive the respective two opposite sides of each of the first panel portion and the second panel portion to thereby retain the respective first and second panel portions therein; and the first panel portion also being connected to the second panel portion along a front edge thereof to a rear edge of the second panel portion so that pivotal movement of the first panel portion from the closed operating condition to the open access condition also moves the second panel portion and so that such pivotal movement to the open access condition allows access into the housing through both the first and second panel portions collectively.

16. A light fixture as defined in claim 15, wherein each one of the pair of retaining clips of the bottom access panel has a first leg extension extending from the rear portion of the bottom access panel toward the front portion of the bottom access panel and a second leg extension extending upwardly from the first leg portion along a medial region of the respective one of the pair of retaining clips at the predetermined angle, the first panel portion being retained by the respective first leg portions of each one of the retaining clips and the second panel portion being retained by the respective second leg portions of each one of the retaining clips.

17. A light fixture as defined in claim 14, wherein each end wall further comprises a slot located in the inner surface thereof and extending along outer peripheries of a rear portion, a top portion, and a front portion of the inner surface to receive therein respective edges of the rear wall, top wall, and front wall of the housing and to be geometrically complimentary to the respective edges of the rear wall, top wall, and front wall of the housing such that the edges of the respective walls are captured within the slot.

18. A light fixture as defined in claim 15, wherein each end wall further comprises:

a front slot located in the bottom portion of the inner surface thereof, adjacent the front wall; and a rear slot located in a rear bottom portion of the inner surface thereof, adjacent the rear wall; and wherein each of respective retaining clips further comprises:

a rear pin extending outwardly therefrom and into in the rear slot; and a front pin extending outwardly therefrom and into the front slot, the front pin being slidable in the front slot for freeing the front pin through an open bottom end thereof to release the bottom access panel for pivotal movement about the rear pin to the open access condition.

* * * * *